US006854661B2

(12) United States Patent
Monitto

(10) Patent No.: US 6,854,661 B2
(45) Date of Patent: Feb. 15, 2005

(54) MISTING FOGGER

(75) Inventor: Perry H. Monitto, Setauket, NY (US)

(73) Assignee: Multi Media Electronics, Inc., Farmingdale, NY (US)

( * ) Notice: Subject to any disclaimer, the term of this patent is extended or adjusted under 35 U.S.C. 154(b) by 31 days.

(21) Appl. No.: 10/322,845

(22) Filed: Dec. 18, 2002

(65) Prior Publication Data

US 2004/0124258 A1 Jul. 1, 2004

(51) Int. Cl.[7] ..... B05B 1/08

(52) U.S. Cl. ..... 239/102.2; 239/16; 239/17; 239/18; 239/20; 239/21; 239/22; 239/23; 239/102.1

(58) Field of Search ..... 239/16, 17, 18, 239/20, 21, 22, 23, 102.1, 102.2, 211, 136; D23/201

(56) References Cited

U.S. PATENT DOCUMENTS

| | | | | | |
|---|---|---|---|---|---|
| 3,561,444 | A | * | 2/1971 | Boucher | 128/200.16 |
| 4,976,259 | A | * | 12/1990 | Higson et al. | 239/102.1 |
| 6,152,383 | A | * | 11/2000 | Chen | 239/102.2 |
| 6,402,046 | B1 | * | 6/2002 | Loser | 239/102.2 |
| 2003/0094508 | A1 | * | 5/2003 | Peng et al. | 239/102.1 |

* cited by examiner

*Primary Examiner*—Robin O. Evans
(74) *Attorney, Agent, or Firm*—Dilworth & Barrese LLP

(57) ABSTRACT

An apparatus for producing fog, said apparatus having ultrasonic circuitry for producing ultrasonic energy for vaporizing a liquid, comprising a receptacle having a recess in the bottom thereof and a surface located at an upper part of said recess for containing said liquid, said recess defining a space devoid of said liquid, wherein said ultrasonic circuitry is located on a bottom of said surface in said recess and positioned such that said ultrasonic energy produced by said ultrasonic circuitry is transferred to said liquid.

8 Claims, 5 Drawing Sheets

MISTING FOGGER

BACKGROUND OF THE INVENTION

1. Field of the Invention

The present invention relates generally to an apparatus for vaporizing a liquid to produce a fogging effect, and more particularly, to an apparatus for vaporizing a liquid to produce a fogging effect by using ultrasonic energy produced by a piezo-electric element.

2. Description of the Related Art

FIG. 1 is a diagram of a typical fogging unit. As shown in FIG. 1, the traditional fogging unit 100 is a self-contained unit comprised of a piezo-electric element 101 for generating ultrasonic energy, and electric circuitry 102 for converting a supplied power to a level to operate the piezo-electric element. Electric circuitry 102 is typically connected to an external power source via electric cord 103 and converts line voltage into a supply voltage to operate the piezo-electric element.

FIG. 2 is a diagram of a fogging unit 200. In addition to the elements of FIG. 1, shown in FIG. 2 is a lamp module 201 attached to the typical fogging unit. The lamp module 201 receives an operating voltage from electric cord 103 through a second electric circuitry 202. The electric circuitry driving the lamp and the electric circuitry driving the piezo-electric element can be combined in the same unit. The fogging units of FIGS. 1 and 2 are available to the consumer as shown, or packaged as a consumer misting product as shown in FIG. 3.

FIG. 3 is a diagram depicting a typical consumer misting product 300 containing the fogging unit 200 unit of FIG. 2. Shown in FIG. 3 are fogging unit 200, bowl 301, water 302, splash guard 303 and splash guard frame 304. Fogging unit 200 is positioned inside of the bowl 301, with electric cord 103 extending out of the bowl 301. Splash guard 303 is positioned above piezo-electric element 101 for preventing water from splashing out of the bowl during operation. The splash guard 303 can be, for example, a rock, a ball, or a plastic sphere. Splash guard 303 is held in position by splash guard frame 304. Splash guard frame 304 is either affixed to the bowl or designed to support itself. Finally, water 302 is placed into the bowl 301 at a level above the piezo-electric element 101 but below the splash guard 303. Also shown is lamp 201 for providing atmospheric lighting to the misting product 300.

In operation, when power is supplied to fogging unit 200, the electric circuitry (not shown) converts the power to a predetermined level and, in turn, supplies the converted power to piezo-electric element 101 and lamp 201. Piezo-electric element 101 begins to vibrate and emit ultrasonic energy at levels designed to vaporize the water 302. As the water 302 is vaporized, fog is produced, which spills over the edge of the bowl 301. For proper fog spillage, the length of the open end of the bowl 301 is generally required to be greater than the height of the bowl 301. Combined with the light illuminated from lamp 201, the fog produces a soothing visual effect.

While the above-described misting produce does produce illuminated fog, there are several problems with the above-described system. First, as the fogging unit is required to be submerged in water during operation, any internal electronics must be potted and sealed. The potting refers to a process wherein electronics that are to be exposed to water are encased in a material that prevents water from contacting the electronics. This process permanently encases the electronics, prevents future repair, and adds additional costs to the overall manufacturing process. The sealing refers to enclosing the potted electronics into a case that provides a space to connect the potted electronics with external elements, namely, the piezo-electric element, lamp, and power cord. This case must also be sealed and heavy enough to allow the entire unit to remain submerged. Generally, the case is manufactured from a metal to provide the needed weight, adding additional costs to the overall unit. All of the connections must be waterproof and sealed. As the potting and sealing processes do not allow for repair of the fogging unit, replacement of the entire fogging unit is required upon any malfunction.

In addition to the above problems, several others exist. The unsightly power cord must be draped over the side of the bowl from the inside to the outside, detracting from the overall soothing visual effect. Also, with the lamp positioned below the water level, much of the light is lost to diffraction in the water. Finally, the submersion of the fogging unit can result in an electric shock hazard if the electric components of the fogging unit become exposed to the water.

SUMMARY OF THE INVENTION

It is, therefore, an object of the present invention to provide an apparatus for vaporizing a liquid to produce a fogging effect by using ultrasonic energy produced by a piezo-electric element, wherein a fogging unit is outside of the liquid.

It is another object of the present invention to provide an apparatus for vaporizing a liquid to produce a fogging effect by using ultrasonic energy produced by a piezo-electric element, said apparatus being illuminated by at least one lamp outside of the liquid.

It is a further object of the present invention to provide an apparatus for vaporizing a liquid to produce a fogging effect by using ultrasonic energy produced by a piezo-electric element wherein the electronics of the apparatus remain accessible to facilitate possible future repairs.

It is yet a further object of the present invention to provide an apparatus for vaporizing a liquid to produce a fogging effect by using ultrasonic energy produced by a piezo-electric element wherein the apparatus does not require costly potting, sealing and waterproof parts.

To achieve the above and other objects, according to one aspect of the present invention, an apparatus is provided for producing fog, said apparatus having ultrasonic circuitry for producing ultrasonic energy for vaporizing a liquid, comprising a receptacle having a recess in the bottom thereof and a surface located at an upper part of said recess for containing said liquid, said recess defining a space devoid of said liquid, wherein said ultrasonic circuitry is located on a bottom of said surface in said recess and positioned such that said ultrasonic energy produced by said ultrasonic circuitry is transferred to said liquid.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENT

A preferred embodiment of the present invention will be described herein below with reference to the accompanying drawings in the following description, well-known functions or constructions are not described in detail since they would obscure the invention in unnecessary detail.

While water is used throughout the application during the description of the operation of the present invention, other liquids capable of vaporization through means of ultrasonic vibrations are anticipated.

Figure 1:
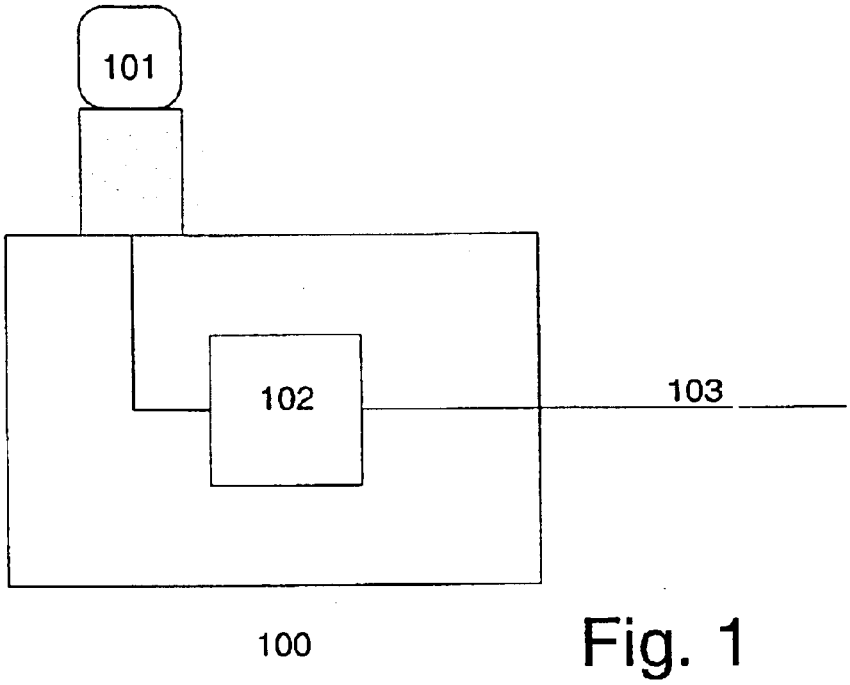
FIG. 1 is a diagram of a conventional fogging unit.
Figure 2:
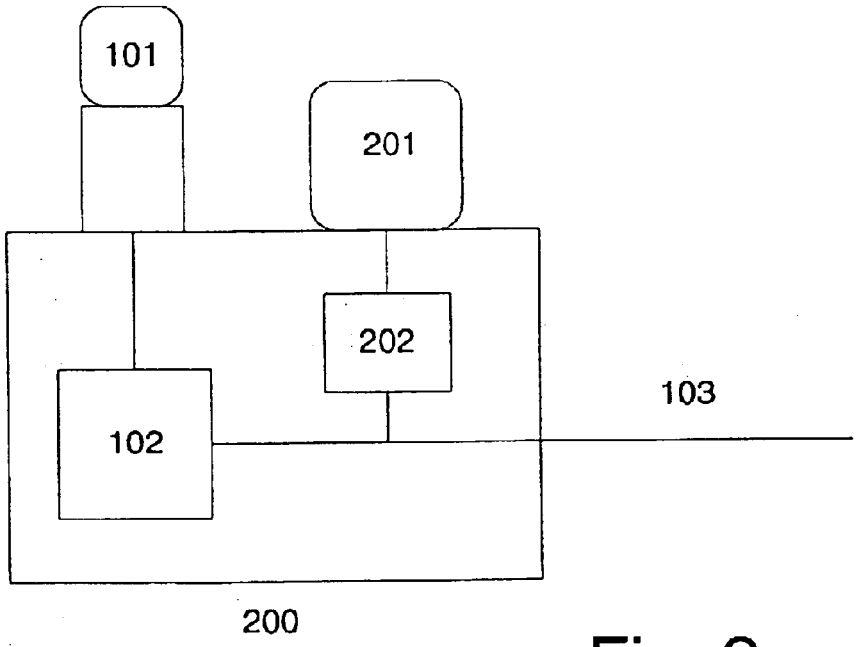
FIG. 2 is a diagram of the conventional fogging unit of FIG. 1 including a lamp.
Figure 3:
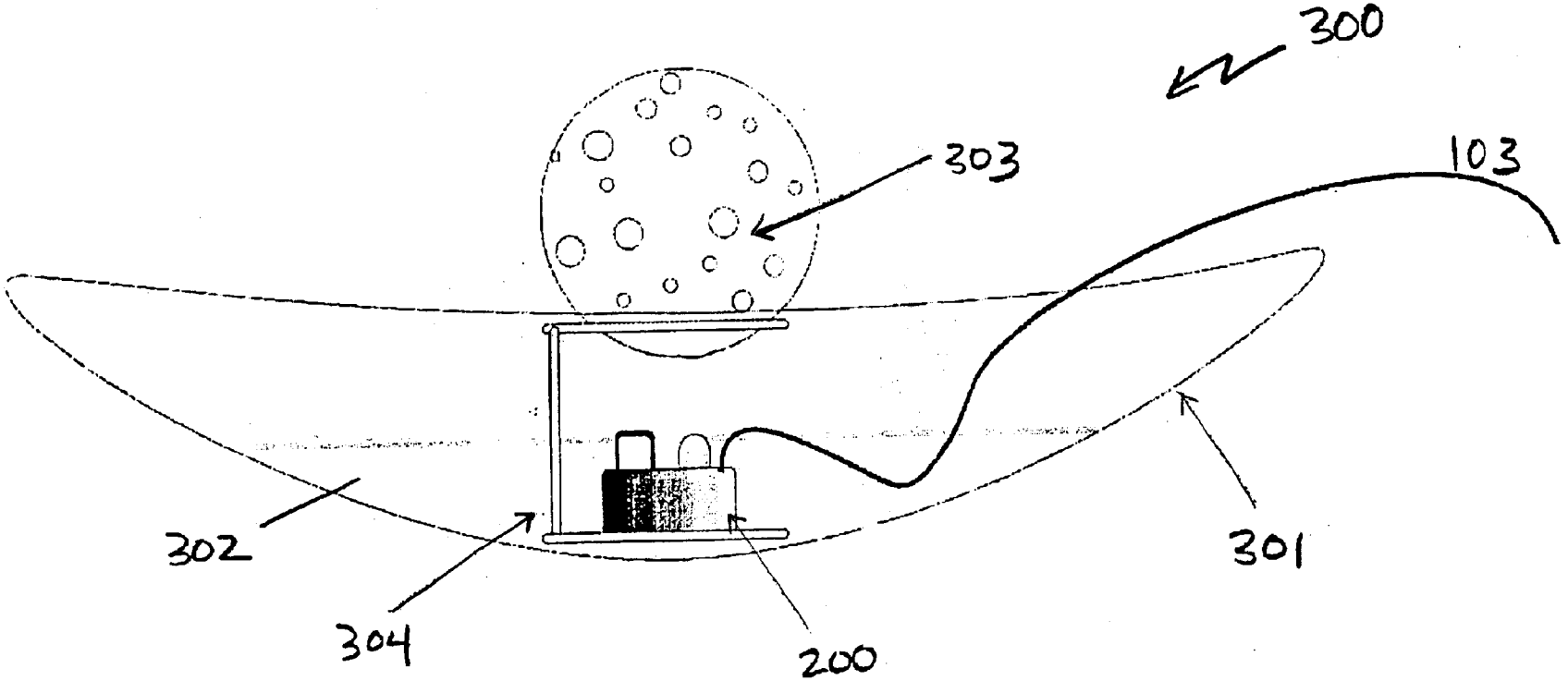
FIG. 3 is a diagram of a conventional misting product incorporating the typical fogging unit of FIG. 2.
Figure 4:
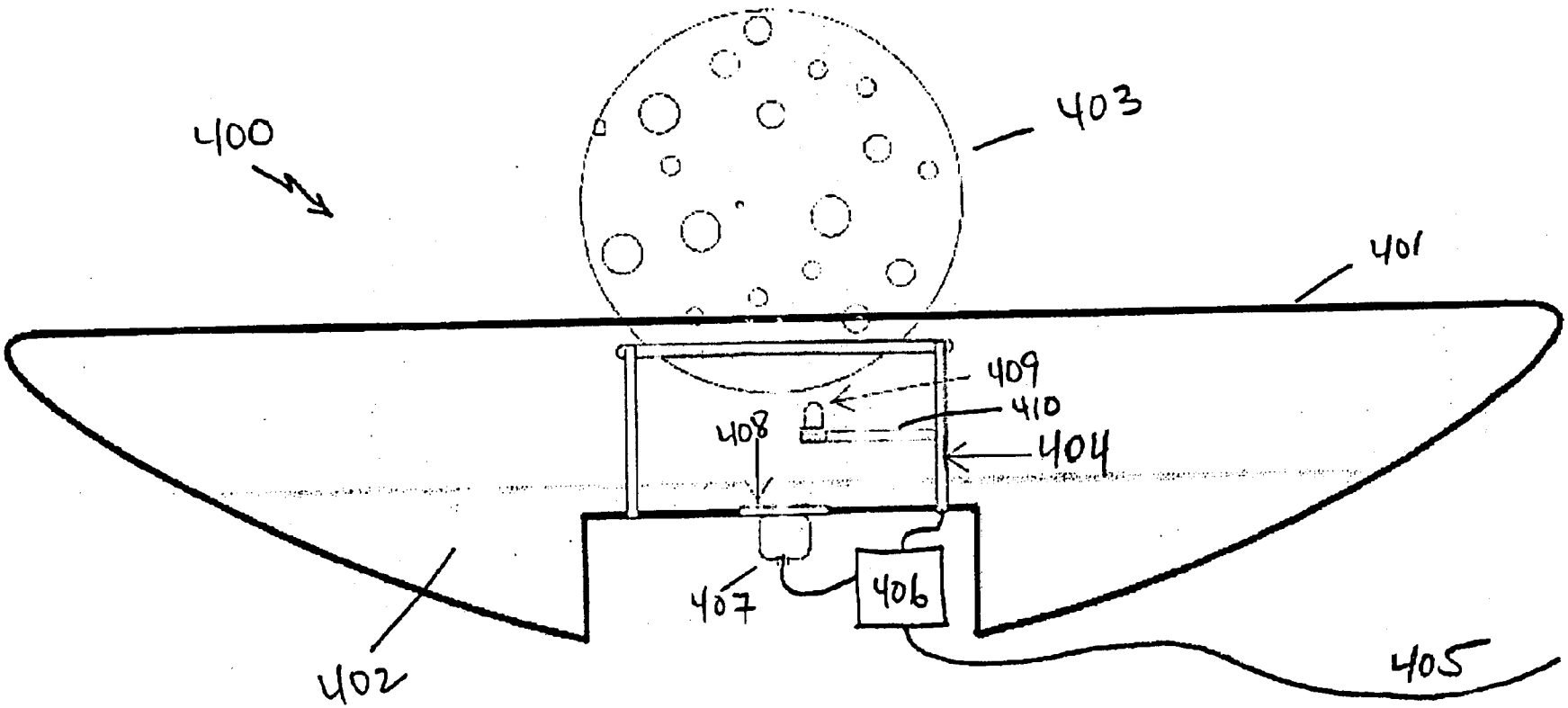
FIG. 4 is a diagram of a misting fogger according to an embodiment of the present invention.

FIG. 4 is a diagram of a misting fogger according to an embodiment of the present invention. Shown in FIG. 4 are misting fogger 400 comprised of bowl 401 containing water 402, and splash guard 403, suspended on splash guard frame 404, for preventing splashing water from escaping from the bowl 401 during operation. Also shown is electric cord 405 for supplying power to the misting fogger 400. Electric circuitry 406 for converting power supplied from electric cord 405 is shown connected to ultrasonic circuitry 407 and is also connected to LED 409 through a wire contained in the splash guard frame 404 and LED support 410. The present invention contemplates one or more than one LED. Electric circuitry 406 and ultrasonic circuitry 407 can be combined into one unit. Ultrasonic circuitry 407 contains a piezo-electric element (not shown) that produces ultrasonic energy to vaporize water 402 contained in bowl 401. Also shown is piezo-electric element water seal 408. Piezo-electric element water seal 408 is designed such that the ultrasonic energy from the piezo-electric element can be transferred from the piezo-electric element to the water 402.

Figure 5A:
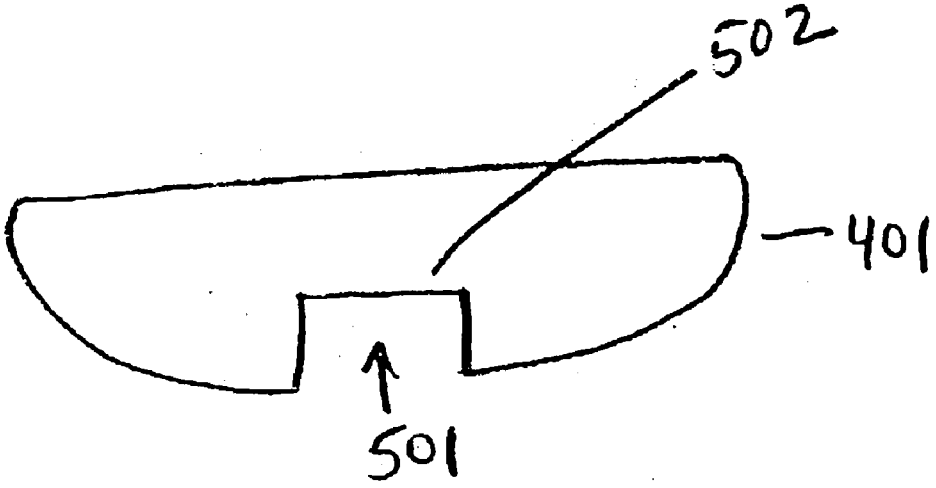
FIG. 5A is a cross sectional view of a bowl shown in FIG. 4.
Figure 5B:
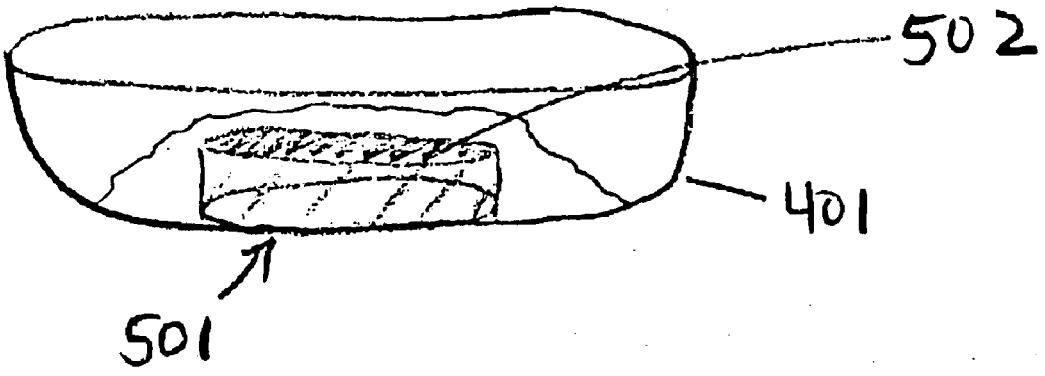
FIG. 5B is a perspective view in particular cutaway of the bowl shown in FIG. 4.

FIG. 5A is a cross sectional view of the bowl 401 shown in FIG. 4. As shown in FIG. 5A, bowl 401 is manufactured to have a recess 501 located at the bottom of bowl 401. FIG. 5B is a perspective view in particular cutaway of the bowl 401 shown in FIG. 4, also showing recess 501 in 3-dimensional detail. Also shown in FIGS. 5A and 5B at the upper section of the recess is a flat surface 502. Flat surface 502 has a hole in which piezo-electric element is mounted. By providing recess 501 in the bowl 401, a space is provided for electric circuitry 406 and ultrasonic circuitry 407 that is not exposed to the water 402. Note that although bowl 401 and recess 501 are shown in a particular shape, other shapes for bowl 401 and recess 501 are anticipated.

Returning again to FIG. 4, operation of misting fogger 401 will be described. Water 402 is placed into bowl 401 to a preset fill line that is above the flat surface 502 but below the LED 409. Power is supplied through electric cord 405 to electric circuitry 406 and ultrasonic circuitry 407. Electric circuitry 406 supplies power to LED 409 through a wire (not shown) located in splash guard frame 404 and LED support 410. Simultaneously, power is supplied from electric cord 405 to ultrasonic circuitry 407. Ultrasonic circuitry 407 converts the power into a form that vibrates the piezo-electric element. The vibration in the form of ultrasonic energy is transferred to water 402 through piezo-electric element water seal 408. At this point the water 402 is vaporized producing a fog that is illuminated by LED 409 and spills over the edge of the bowl.

Three clear advantages are depicted in the embodiment of the present invention shown in FIG. 4 over the prior art. First, electric cord 405 is no longer required to be draping over the upper edge of the bowl 401. Second, as shown in FIG. 4, the LED 409 is above the water level, and therefore, the illumination from LED 409 is not diminished by being submerged under the water 402. Third, and most important, ultrasonic circuitry 407 is contained outside of the water, thus preventing risk of electric shock.

Figure 6:
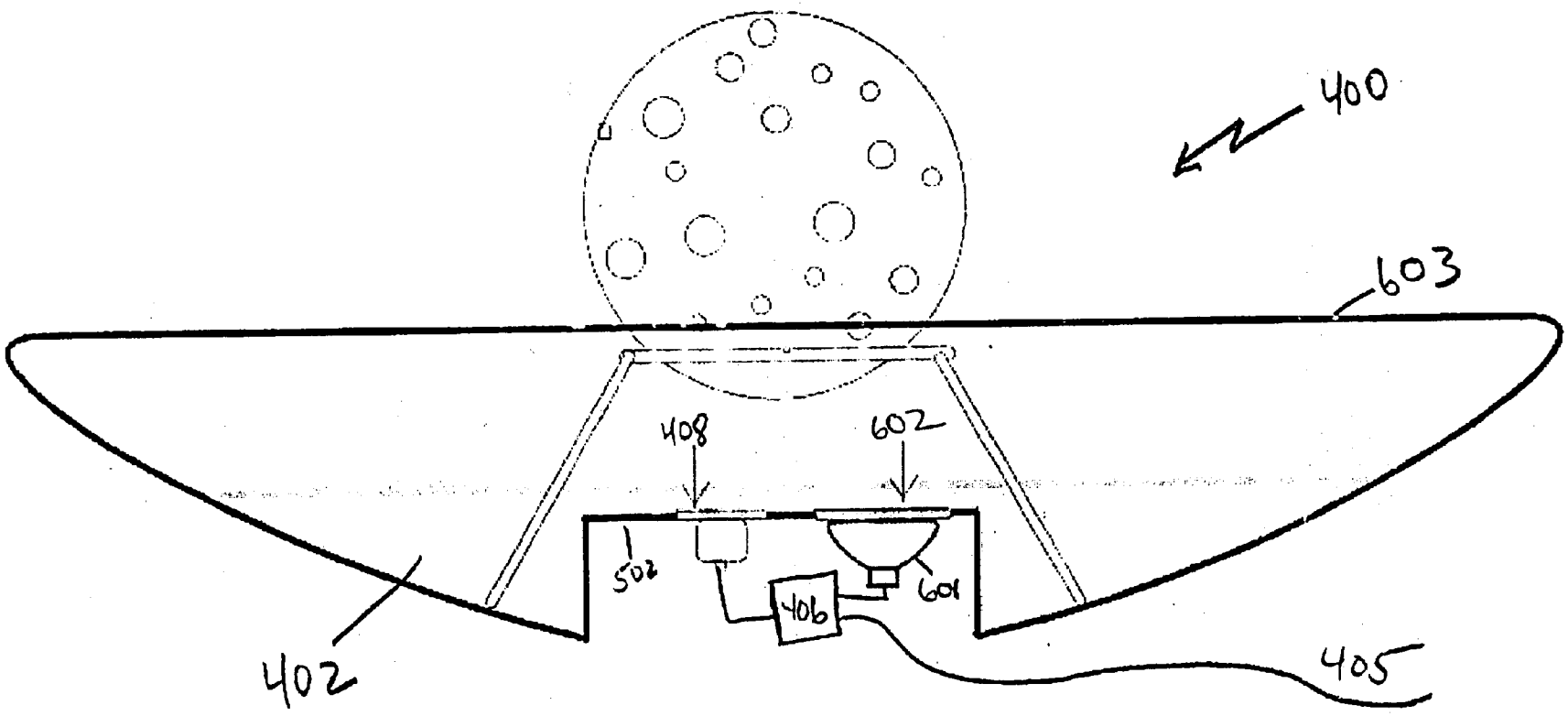
FIG. 6 is a diagram of a misting fogger according to a second embodiment of the present invention.

FIG. 6 is a diagram of a misting fogger according to a second embodiment of the present invention. As shown in FIG. 6, the LED has been removed and lamp module 601 is mounted on flat surface 502. A hole is provided in flat surface 502 to allow light produced by lamp module 601 to illuminate upward. A lamp module water seal 602 is provided to the lamp module 601 from being exposed to the water 402 in bowl 603.

The present invention provides the following advantages. First, the fogging unit is outside of the liquid. Second, the lamp is outside of the liquid. Third, the electronics of the apparatus remain accessible to facilitate possible future repairs. Fourth, the apparatus does not require costly potting, sealing and waterproof parts. Each of these reduces the costs of the manufacturing process, as well as allows repairs over more costly replacement.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. An apparatus for producing a fog, comprising:

a receptacle for containing a liquid having an open top and a closed bottom and having an upward protruding recess located in the bottom of said receptacle, said recess being below an upper surface of said liquid;

a lighting device to illuminate said fog; and an ultrasonic unit contained in said recess for generating ultrasonic energy for vaporizing said liquid contained in said receptacle, said ultrasonic unit mounted within said recess such that said ultrasonic unit transfers its ultrasonic energy to said liquid through an upper surface of said recess;

wherein said ultrasonic unit is disposed outside of said liquid and insulated therefrom.

2. The apparatus of claim 1, further comprising a splash guard positioned above said ultrasonic unit for preventing water from splashing out of said receptacle, said splash guard being supported by a splash guard frame.

3. The apparatus of claim 1, wherein said lighting device is positioned above said upper surface of said liquid.

4. The apparatus of claim 1, wherein the ultrasonic unit is a piezo-electric element.

5. The apparatus of claim 2, wherein the lighting device comprises at least one LED mounted on said splash guard frame.

6. The apparatus of claim 1, wherein the lighting device comprises a lamp module mounted in said recess to provide upward illumination.

7. An apparatus for producing fog, said apparatus having ultrasonic circuitry for producing ultrasonic energy for vaporizing a liquid, comprising:

a receptacle having a recess in the bottom thereof and a surface located at an upper part of said recess for containing said liquid, said recess defining a space devoid of said liquid, and a lighting device for illuminating said fog;

wherein said ultrasonic circuitry is located on a bottom of said surface in said recess and positioned such that said ultrasonic energy produced by said ultrasonic circuitry is transferred to said liquid.

8. A method for producing an illuminated fog, comprising:

containing a liquid in a receptacle having an open top, a closed bottom and an upwardly protruding recess in the bottom of the receptacle, positioning said recess below an upper surface of the liquid;

generating, via an ultrasonic unit, ultrasonic energy for vaporizing the liquid to create fog, transferring the ultrasonic energy to the liquid through an upper surface of the recess; and illuminating said fog with a lighting device.

* * * * *